US005613899A

United States Patent [19]

Weiss et al.

[11] Patent Number: 5,613,899

[45] Date of Patent: Mar. 25, 1997

[54] CENTERLESS CERAMIC FERRULE GRINDER

[75] Inventors: Stanley Weiss, Boston; Cosper Nance, Moultrie, both of Ga.

[73] Assignee: Southern Carbide Specialists, Inc., Quitman, Ga.

[21] Appl. No.: 462,074

[22] Filed: Jun. 5, 1995

[51] Int. Cl.[6] ..... B24B 5/00; B24B 5/18

[52] U.S. Cl. ..... 451/245; 451/177

[58] Field of Search ..... 451/177, 226, 451/276, 365, 41, 242, 244, 245, 55

[56] References Cited

U.S. PATENT DOCUMENTS

| | | | |
|---|---|---|---|
| 2,020,541 | 11/1935 | Ernst | 451/242 |
| 2,794,304 | 6/1957 | Frankiewicz et al. | 451/242 |
| 3,043,059 | 7/1962 | Thompson | 451/242 |
| 3,358,405 | 12/1967 | Ruderfer et al. | 451/242 |
| 3,528,199 | 9/1970 | Marley | 451/242 |
| 3,685,212 | 8/1972 | Schaller | 451/242 |
| 4,783,932 | 11/1988 | Sager | 451/242 |

FOREIGN PATENT DOCUMENTS

| | | | |
|---|---|---|---|
| 91011291 | 8/1991 | WIPO | 451/242 |

*Primary Examiner*—James G. Smith
*Assistant Examiner*—Derris H. Banks
*Attorney, Agent, or Firm*—Brian D. Bellamy

[57] ABSTRACT

The novel ferrule grinding machine of the present invention has a wire support assembly having a wire that stretches the length of the wire support on which ferrules are strung. The wire rests in a novel guide that aids in producing ferrules within tolerances. The machine also has a grinding wheel and regulating wheel whose speed and composition may be changed to determine the surface finish and concentricity of a ferrule. The regulating wheel infeed assembly controls the size of the ferrules via a computer and a step motor that control the position of the regulating wheel as it tilts on a pivot base to attain the correct size of ferrule. The wire support assembly is placed on a variable speed work traverse that carries the work between the grinding wheel and regulating wheel, while the ferrules are supported on a rest blade such that the ferrules are worked slightly above their center.

19 Claims, 7 Drawing Sheets

CENTERLESS CERAMIC FERRULE GRINDER

INTRODUCTION

This invention relates to a centerless grinding machine adapted for producing ferrules that carry fiber optic cable, and more particularly, to an abrading machine that shapes ferrules concentrically within very small tolerances and applies a very fine surface finish.

In the electronic media industry, fiber optics requires a ceramic insulator. Ceramic ferrules are used. Fiber optics has evolved to be a highly desirable and advantageous means of transmitting electronic information. Accordingly, very large quantities of ceramic ferrules are needed to support the fiber optics industry. Therefore, a procedure for mass producing high quality ferrules efficiently is needed and would be very desirable.

For efficient fiber optic conductivity, the ceramic ferrules used to insulate fiber optic cable must have a concentricity of plus or minus one (1) micron or better and a surface finish of G.A.O. 4 RMS. Producing large quantities of ferrules with such stringent specifications, presents a quality problem because it is very difficult to achieve this precision. In many instances, tolerances are relaxed in order to produce a larger quantity of at least marginally usable ferrules, while many ferrules are thrown away when they are too far out of tolerance and unusable. Present practice is to grind about sixty ferrules at a time. Sixty ferrules represent a large quantity of ferrules to attempt to grind at one time and still hope to achieve consistent results. Using this method trades quantity for quality in hope of producing a satisfactory number of usable ferrules. Grinding a smaller number of ferrules at a time is not very helpful under present circumstances because quality is too low, even when grinding only 30 ferrules at a time, to produce enough quality parts. Therefore, it is logical and most efficient using these earlier machines to attempt to grind as many ferrules as possible to get as many acceptable ferrules as possible during each run.

The conventional grinding machine commonly used by the industry for shaping ceramic ferrules has a grinding wheel and a regulating wheel. The grinding wheel shapes the ferrules, and the regulating wheel controls the amount of material removed by the grinding wheel. Furthermore, these machines use a string carrier wire and a hydraulic traveler outfit to hold the wire with ferrules and move the ferrules through the grinding and regulating wheels. In use, the speed of the hydraulic traverse on conventional ferrule grinding machines cannot be controlled, making it difficult to regulate the final size and finish of the ferrule parts.

These prior traverses do not include any means along the length of the wire to straighten the path of the wire when it is held in tension. The wire carrying ferrules is pulled off center in relation to the grinding means by the forces holding the wire in tension. If the wire is held off center in relation to the grinding means, it is more difficult to achieve the required concentricity of ferrules. Additionally, these prior traverses are made for carrying 60 ferrules at a time. Thus, the traveler outfit is longer, making it more difficult to handle during loading of ferrules and even more subject to cause the wire to be off center.

In addition to a grinding wheel and regulating wheel, the earlier machines also use a rest blade to support the ferrules against the grinding wheel. These machines use the rest blade to hold the size of a ferrule by raising the rest blade slightly above the center of the grinding wheel and regulating wheel, thus holding the ferrules such that the grinding wheel grinds them slightly below their center. Causing the ferrules not to have the specified concentricity, grinding below the ferrules' center gives the ferrules an elliptical, rather than cylindrical, shape.

Accordingly, an object of the present invention is to produce concentric ferrules suitable for use in carrying fiber optic cable;

Another object of the present invention is to achieve concentricity of ferrules of about 1 micron;

Another object of the present invention is to achieve surface finish of ferrules of about G.A.O. 4 RMS;

Another object of the present invention is to provide a ceramic ferrule grinding machine that will grind 30 ferrules at a time all within tolerance.

Another object of the present invention is to provide a heavy duty ceramic ferrule grinding machine that can produce high quantities of high quality ferrules reliably.

Yet, another object of the present invention is to increase the quantity of high quality ferrules that can be produced.

These and other objects of the invention will be apparent to those persons skilled in this art from the following detailed description of a preferred embodiment of the invention.

BRIEF SUMMARY OF THE INVENTION

The improved centerless ceramic ferrule grinder of the present invention provides an apparatus that abrades ceramic ferrule parts for use with fiber optic cable with greater accuracy and efficiency. The preferred centerless grinder incorporates a work traverse that oscillates horizontally with a wire support assembly for carrying about 30 ferrules at a time. The wire support assembly has an arm on each end by which a wire is attached and held between the arms in tension. Wire guides are incorporated into the wire support assembly to hold the wire straight while the grinder operates. A grinding wheel means for abrading the ferrules and a regulating wheel means for controlling the amount of abrasion are positioned on the apparatus such that the wire can carry the ferrules between the two means. The infeed means governs the position of the regulating wheel means by moving the regulating wheel means in increments in relation to the grinding wheel means. Lastly, as the ferrules are moved by the work traverse, a rest blade assembly supports the ferrules such that the ferrules are worked above their center by the grinding wheel means.

BRIEF DESCRIPTION OF THE DRAWINGS

The invention will be described below with reference to the accompanying drawings showing an embodiment of the invention.

DETAILED DESCRIPTION

Centerless grinders commonly are used in finishing ceramic ferrules. Like this invention, conventional ceramic ferrule grinders use a grinding wheel to remove material and a regulating wheel to control the amount of material being removed. However, grinding ceramic ferrules to carry fiber optic cable using centerless grinder technology before this invention has been an erratic and problematic endeavor. First, these prior machines could not adequately regulate the amount of material removed from a ferrule by grinding, an essential step in producing ferrules that satisfy the precision tolerances required by fiber optics. Secondly, these prior machines could not control the concentricity of the ferrules, resulting in ferrules having elliptical shapes and variable concentricities.

Figure 1:
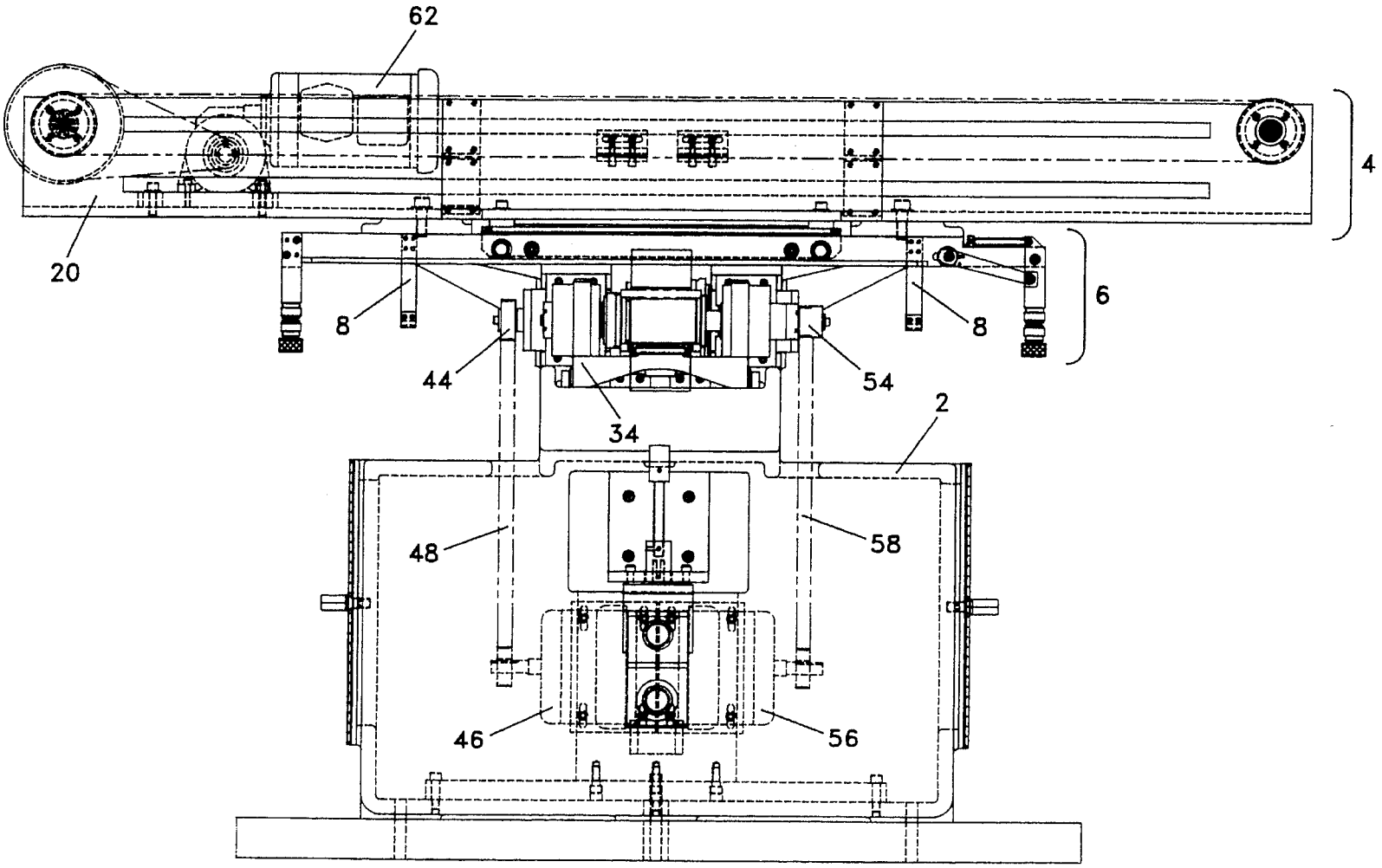
FIG. 1 is a front view of the ceramic ferrule grinder, shown with its novel work traverse with wire guides and wire support assembly, constructed in accordance with the teachings of the present invention.

A centerless grinder for finishing ceramic ferrules of the general type having a grinding wheel, a regulating wheel, and a rest blade, but which incorporates a preferred embodiment of the present invention, is shown in FIG. 1. The present invention improves upon the prior art by producing a high quantity of high quality ferrules more effectively. It includes a heavy duty sturdy main frame 2 casted of cast iron that supports the subassemblies that make up the present novel centerless grinder. These subassemblies include a work traverse 4, a wire support assembly 6 with wire guides 8, a grinding wheel assembly 10, a regulating wheel assembly 12, a regulating wheel infeed assembly 14, a rest blade assembly 16, and a pivot base assembly 18.

Figure 2:
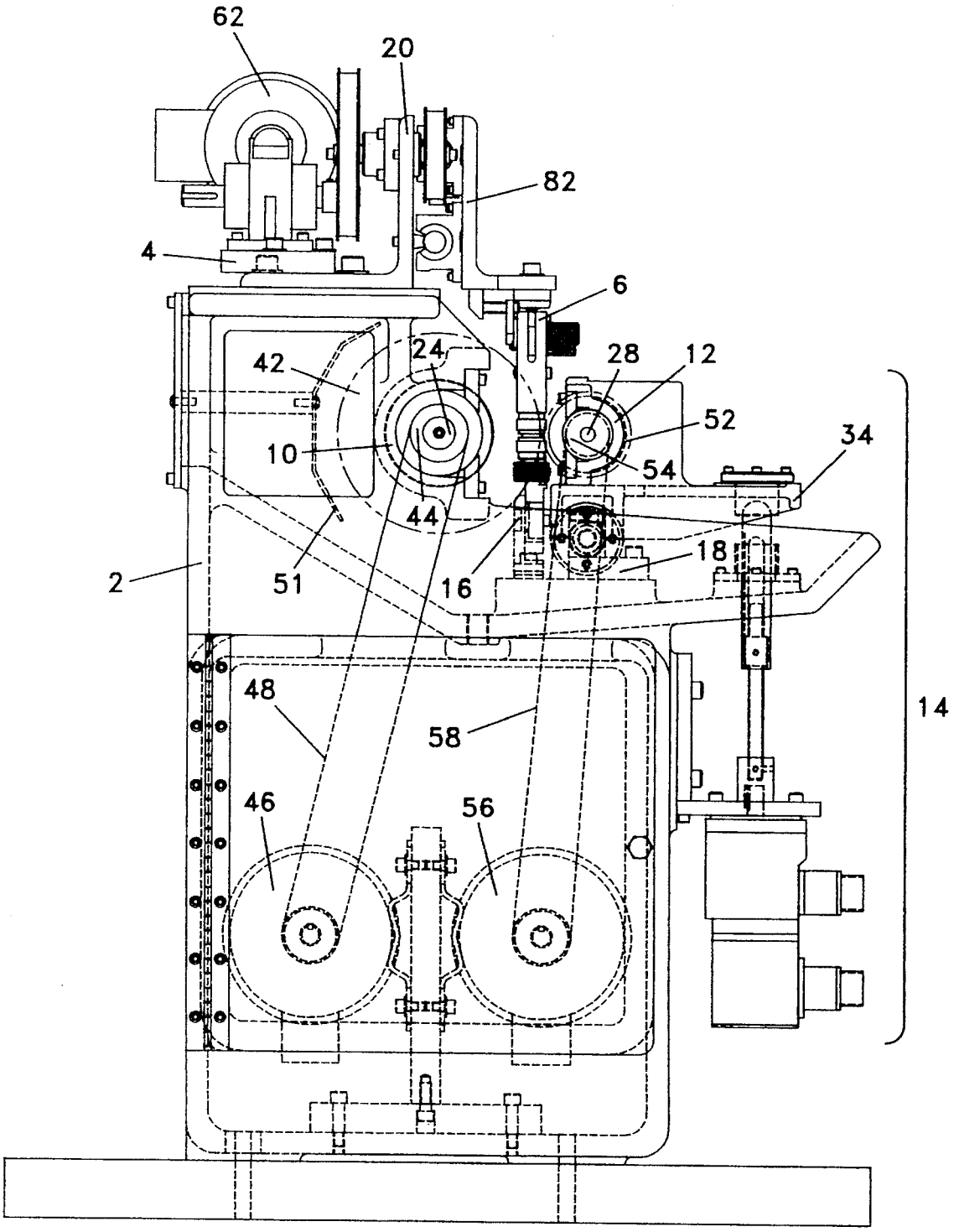
FIG. 2 is a left side view showing in greater detail the ceramic ferrule grinder shown in FIG. 1.

FIG. 2 shows the relationship between these subassemblies in more detail from a left side view. The work traverse 4 is attached to the top of the main frame 2. Preferably, the work traverse is attached using a carriage support 20, preferably made of aluminum, that is bolted securely to the main frame. The work traverse could be attached to the main frame via any suitable means that is sturdy and durable. Then, the wire support assembly 6 is bolted to the work traverse and suspended therefrom.

The main frame 2 further accommodates the grinding wheel assembly 10 below the work traverse and behind the wire support assembly 6 within a casting that is an integrated part of the main frame. In its preferred embodiment, the present invention uses a revolving means for grinding that is held in its casting by a grinding wheel spindle 24 that permits the grinding means to revolve freely.

Likewise, the main frame accommodates a means for regulating the amount of material removed by the revolving grinding means. The preferred regulating means is a revolving wheel and is held in place on the main frame by a regulating wheel spindle 28. Further, the preferred regulating means is positioned in front of the wire support assembly so that the wire support assembly traverses behind the revolving regulating wheel means and in front of the grinding wheel means, permitting ferrules 30 held by the wire support assembly to move between the grinding wheel means and regulating wheel means and to be worked. The regulating wheel infeed assembly 14 in the preferred embodiment is securely affixed to the front side of the main frame and includes the regulating wheel casting 34 that supports the regulating means.

Figure 8:
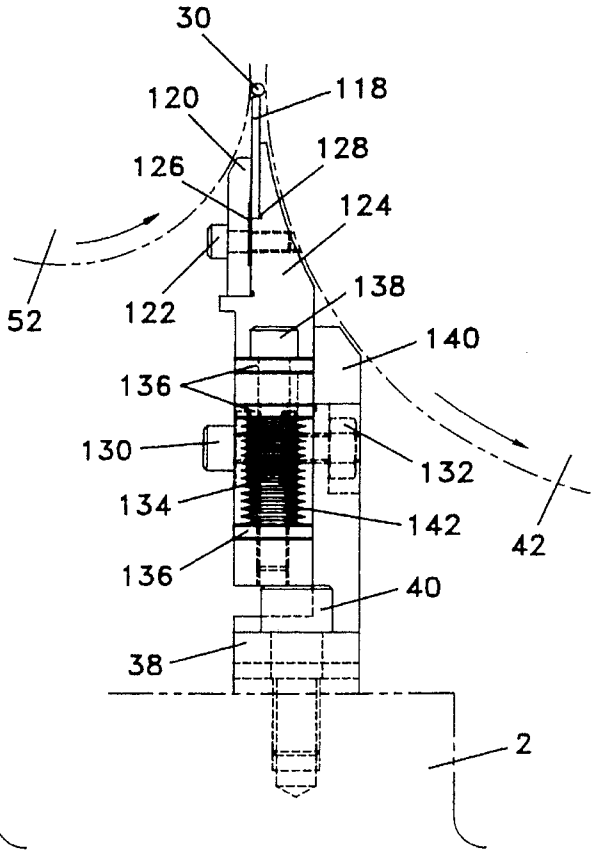
FIG. 8 is a right side view of the rest blade assembly and shows the relation between the rest blade assembly, a ferrule, a grinding wheel, and a regulating wheel.
Figure 7:
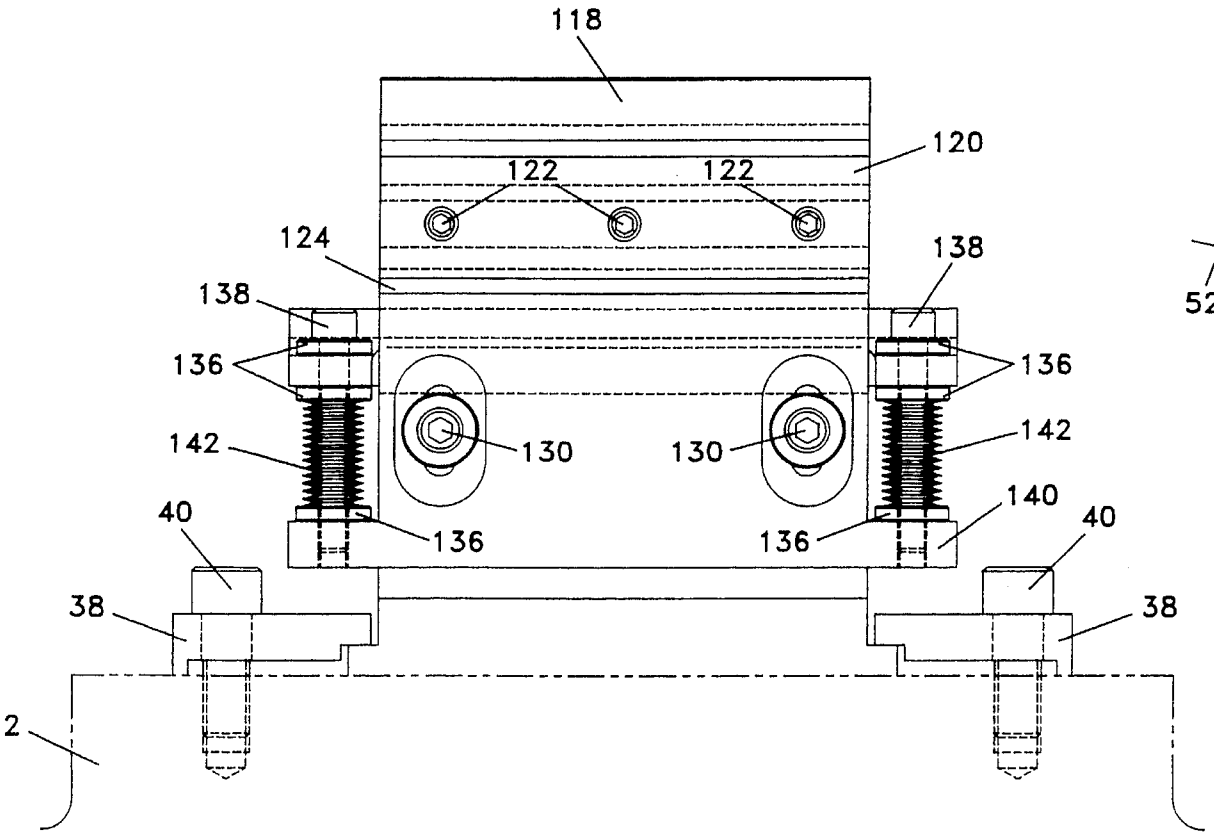
FIG. 7 is a front view of the rest blade assembly.

Finally, referring to FIG. 7 and FIG. 8, the rest blade means 36 resides between the regulating wheel means and the grinding wheel means so that a ferrule that is supported by the rest blade means rests between the grinding wheel means and the regulating wheel means, allowing the part to be worked. Preferably, the rest blade means is secured to the main frame by a base clamp 38 and socket head cap screws 40.

The figures further illustrate the elements of the present invention in more detail as will be described below. First, FIG. 2 described above illustrates the preferred means for grinding the ferrules and regulating the material removed. These preferred means are embodied in the grinding wheel assembly 10 and the regulating wheel assembly 12. The particular grinding means and regulating means concepts were previously known in the art and are not considered particularly novel, except as embodied in and used in the present invention.

The preferred grinding wheel assembly comprises a grinding wheel 42 held within the main frame that revolves about the grinding wheel spindle 24 previously referred to above. A grinding wheel pulley 44 attaches to the spindle of the grinding wheel, and a suitable grinding wheel motor 46, preferably a variable speed electric motor, drives the grinding wheel by a grinding wheel motor belt 48 that wraps about the grinding wheel pulley. Using this or a similar arrangement, the revolving grinding wheel works the ferrules to shape and finish them.

The grinding wheel, also referred to as a work wheel, has a granular surface texture for removing material from the ceramic ferrules 30. Depending on the quality of finish desired and the speed at which the part needs to be worked, the preferred grinding wheel may have a grit of 800 to 1200 ppsi U.S. standard mesh size. Using an 800 grit grinding surface would cause the part to be shaped faster and have a lower quality finish. While, using a finer 1200 grit grinding surface would cause the part to be shaped slower but have a higher quality finish. Likewise, lower or higher grits could be used depending on the speed and finish desired for producing the ferrule. In practice, the granular surface of the grinding wheel often wears out very quickly, resulting in lost precision and efficiency of the machine. To overcome this deficiency in the present invention's grinding wheel, the granular surface is formed of a hard and highly durable diamond bond. It is well known in the art that the diamond bonded surface is advantageous because it maintains its precision grinding surface and grinding efficiency over time.

Another complication that has been found in practice is that excess dirt and debris enters the bearings of the grinding wheel spindle and the regulating wheel spindle. In the preferred embodiment of the present invention, the grinding wheel spindle has air purged bearings. These conventional air purged bearings force dirt and debris out of the bearings, prolonging the life of the bearings and decreasing the maintenance costs for the machine. Likewise, the preferred embodiment includes a splash guard 51 placed behind the grinding wheel thereby preventing splatter coming from the grinding wheel from spreading over different parts of the machine.

The preferred embodiment of the regulating wheel assembly 12 consists of a regulating wheel 52 held within the main frame by the previously referred to regulating wheel spindle 28. A regulating wheel pulley 54 attaches to the spindle of the regulating wheel, and a suitable regulating wheel motor 56, preferably a variable speed electric motor, drives the regulating wheel by a regulating wheel motor belt 58 that wraps about the regulating wheel pulley. Using variable speed motors to drive the grinding wheel and regulating wheel, the speed of the wheels can be changed to affect the speed at which the ferrules are shaped and finished. Like the grinding wheel spindle, the preferred regulating wheel spindle has air purged bearings that force out dirt and debris, thereby increasing the durability of the machine. In this arrangement, the regulating wheel revolves in a direction opposite that of the grinding wheel and helps to control the amount of material removed from the ferrule 30 in the shaping and finishing process.

In operation, the regulating wheel 52 does not remove any product from the ferrule. The regulating wheel is moved toward the grinding wheel 42 a particular distance and drives the ferrule as it spins against the grinding wheel. The regulating wheel's primary purposes are to drive the ferrules causing them to spin, to control the amount of material removed in shaping the ferrules, and to help provide the desired ferrule size and concentricity. Consequently, the novel regulating wheel of the present invention is formed of a hard polyurethane material mixed with an abrasive that has a mesh size of about 400 grit. The abrasive material may be any suitable abrasive, but that is less hard and durable than the diamond abrasive used in the grinding wheel. The regulating wheel of the present invention has a preferred hardness of 65 durameter on a D scale. In the present art, the D scale measure of hardness is somewhat harder than an A scale measure. Using a regulating wheel with the desired characteristics, the regulating wheel assembly operates together with the grinding wheel assembly to shape and finish the ferrules as they traverse between the two assemblies.

Figure 3:
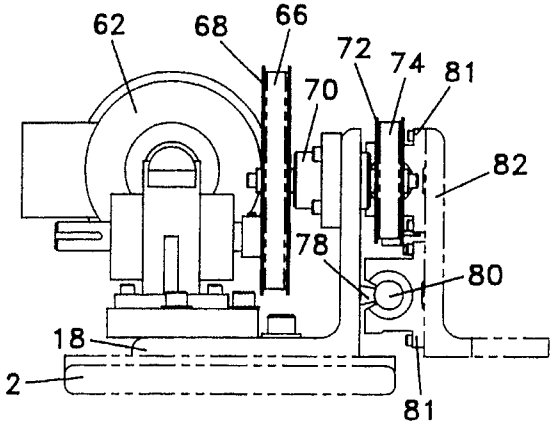
FIG. 3 is a left side view of the top view of the work traverse portion.
Figure 4:
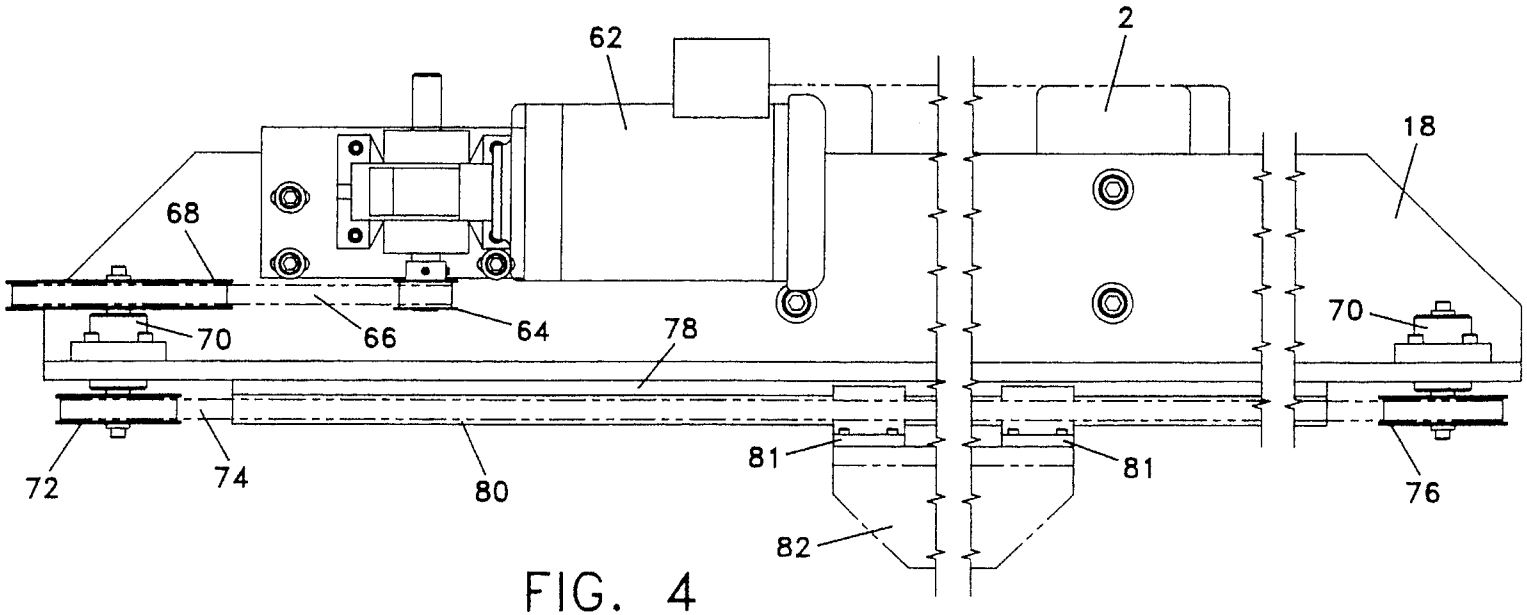
FIG. 4 is a top view of the work traverse portion of the apparatus.

The preferred work traverse 4, shown in more detail in partial views FIGS. 3 and 4, consists of a work traverse motor 62 that drives an assembly of pulleys and belts that result in the traversing action of the work traverse. The work traverse motor directly drives a pulley 64 having a continuous belt 66 about it. This belt acts to drive the work traverse by wrapping about a timing belt pulley 68 that revolves about a bearing housing 70, below which a second timing belt pulley 72 is positioned. The timing pulley actually drives the work traverse by propelling a timing belt 74 that drives the traverse and wraps around the idling pulley 76 at the right side opposite end of the work traverse. In the preferred embodiment, a shaft rail 78 is integrated into the carriage support 20. A shaft 80, preferably formed of Thompson Shafting, is affixed along the length of the shaft rail and passes through pillow blocks 81. A ferrule part feed carriage 82 is connected to the work traverse by the shaft 80 passing through pillow blocks 81. The pillow blocks comprise linear bearings that permit the ferrule part feed carriage to move along the shaft. Thus, the ferrule part feed carriage may traverse the length of the shaft creating a work traverse, whereby the ferrules are shaped and finished as they traverse between the grinding means and regulating means.

Figure 5:
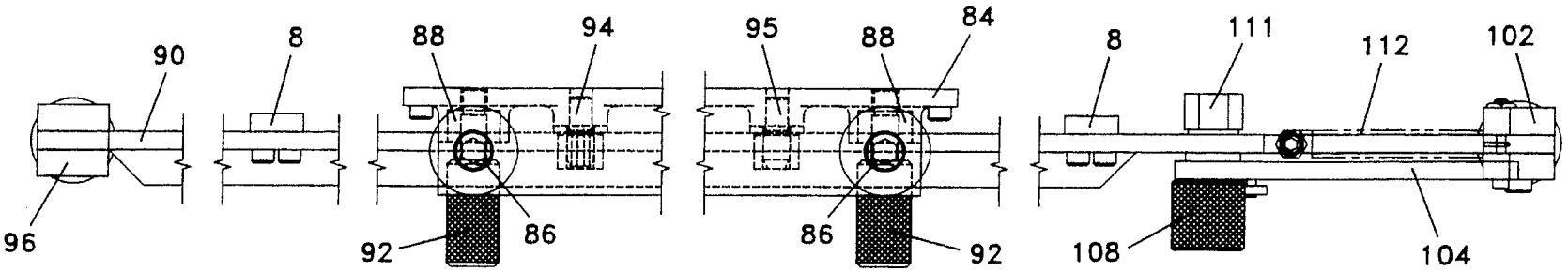
FIG. 5 is a top view of the novel wire support assembly portion of the apparatus.
Figure 6:
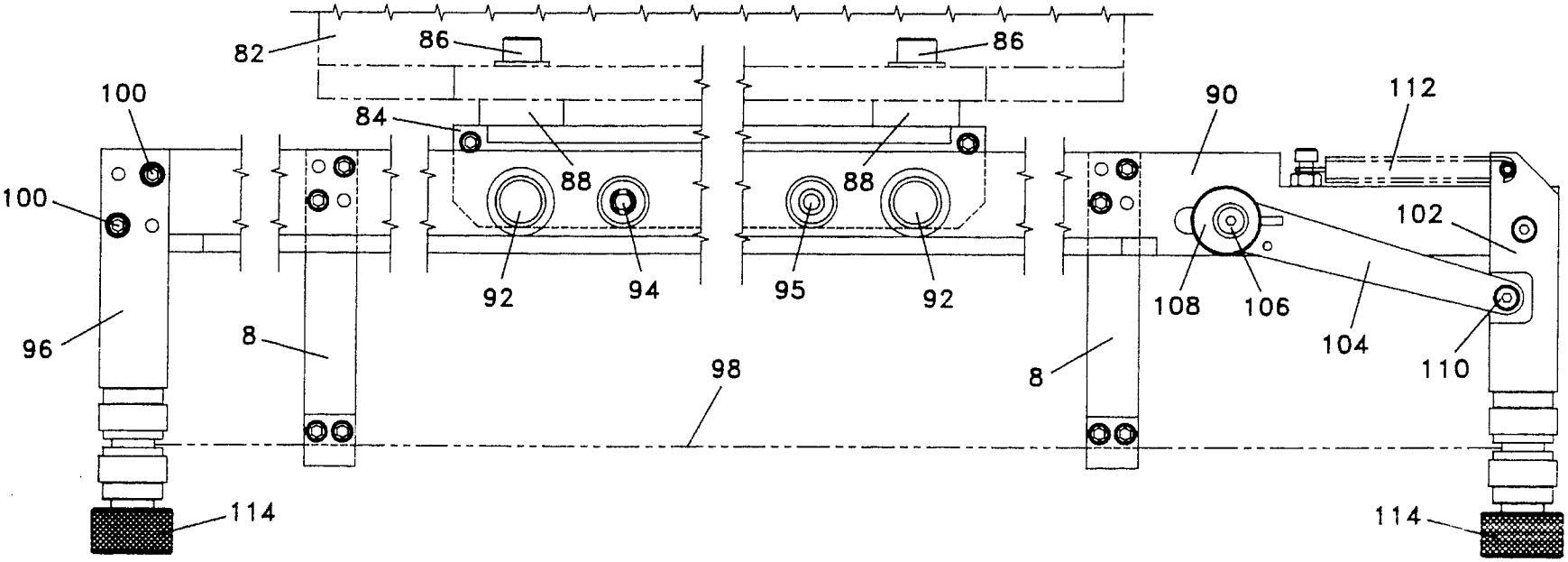
FIG. 6 is a front view of the wire support assembly.

The ferrules are supported on the ferrule part feed carriage 82 by the wire support assembly 6. FIGS. 5 and 6 show the preferred wire support assembly in more detail. The preferred wire support assembly joins to the ferrule part feed carriage that is on the work traverse by a wire holder bracket 84 held in place by bolts 86. Shims 88 separate the wire holder bracket from the ferrule part feed carriage. The wire holder bracket holds the remainder of the wire support assembly so that the remainder of the assembly is detachable. A wire holder frame 90 is connected to the wire holder bracket and tightened to it by hand using lock screws 92. A diamond shaped dial pin 94 in combination with a round dial pin 95 holds the wire support assembly parallel on the ferrule part feed carriage so that the ferrules are finished with precise concentricity. The diamond shaped dial pin also gives a degree of freedom in the horizontal direction, making the wire support assembly easier to remove and replace.

The preferred wire support assembly shown in FIGS. 5 and 6 further has two arms. A first arm 96, shown in FIG. 6 on the left side of the front view, is stationary and extends downward to a wire 98 that ferrules are threaded onto. In the preferred embodiment, the first arm is held stationary by two bolts 100. A second arm 102, shown in FIG. 6 on the right side of the front view, is mobile. The second arm is on the tension end of the wire support assembly and is attached to the wire holder frame 90 by a link 104 and a bolt 106.

Preferably, the link is attached to the aluminum angle part by a bolt having an eccentric knob 108 at its head, referred to as an eccentric release knob herein. The link extends to the second arm where it is attached by a bolt 110 and an eccentric lock nut 111 about which the bar can pivot. Because the eccentric release knob is eccentric, it can be turned to adjust the link to extend the second arm outward away from the first arm or inward toward the first arm. Thus, the wire may be tightened or loosened, respectively. A spring 112 is connected between the wire holder frame and the second arm to pull on the upper end of the second arm, thereby applying outward tension on the lower end of the second arm where it holds the wire. Both the first and second arms have adjustable torque thumbscrews 114 on the ends of them to allow tightening by hand for holding the wire securely in tension, while permitting quick removal and loading.

Preferably, between the first arm 96 and the second arm 102, are two wire guides 8 that are affixed to the wire holder frame 90 between the arms of the wire support assembly. Prior ceramic ferrule grinders failed to produce parts within tolerance because the wire would not be held straight during grinding of parts. The prior art does not use wire guides. Therefore, the adjustments for tension at the point where the wire attached to the prior art wire support pulls the wire at an angle causing it to become off center. Prior to this invention, those persons skilled in the art could not overcome this problem partly because of the demand to work about 60 ferrules at a time to meet production needs, thus inhibiting consideration of solutions that would shorten the span of the wire carrying ferrules.

As discussed above, the present invention increases the number of acceptable ferrules produced by dramatically increasing the quality of ferrules produced. An important step in providing the dramatic increase in the quality of ferrules produced is the addition of the wire guides. With the addition of wire guides and the shortening of the wire support assembly, the present invention shortens the span of the wire to permit carrying only about 30 ferrules at a time. However, the present invention is more efficient than the prior art because a much higher proportion of the ferrules produced are within tolerances.

The addition of wire guides 8 has improved ceramic ferrule grinders by securely holding the wire 98 carrying the ferrules along a predetermined straight path. Preferably, ferrule sized spacers are used with of the wire guides that the wire passes through. Therefore, as the wire traverses between the grinding and regulating means, the wire guides are separated from the ferrules and do not interfere with the ferrule shaping and finishing process. The addition of the wire guides helped satisfy the primary objective of the invention to produce high quality ferrules for use in carrying fiber optic cable and improve the usefulness of the present centerless ceramic ferrule grinding machine.

FIGS. 7 and 8 show the rest blade assembly 16 in more detail. A ferrule 30 rests on the top edge of a rest blade 118. To prevent wear and preserve precision, the rest blade's top edge preferably is formed of diamond, but may also be formed of a carbide or a comparably hard material. The rest blade is joined to a rest blade clamp 120 by screws 122 and a blade rest 124. The rest blade clamp has a slight recess 126 that causes the top of the rest blade clamp to be pulled snugly against the rest blade when the screws are tightened, preventing the rest blade from slipping out of position. Also, the rest blade clamp has a step 128 that further supports the rest blade by its bottom edge.

The blade rest and the blade base are held together by socket head cap screws 130 having nuts on the threaded end. These nuts can be tightened to hold the rest blade assembly together. Beveled washers 134 placed between the blade rest and blade base and placed about the socket head cap screws make the tightened connection spring loaded to help avoid slip. Furthermore, the blade rest 124 has flanges 136 that adjustment screws 138 pass through to join the blade rest to the blade base. The blade base has flanges 140 that the adjustment screws terminate within. Beveled washers 142 are stacked about each of the adjustment screws and act as precision springs. These beveled washers help to control adjustments to the position of the rest blade. The beveled washers and the adjustment screws work together in adjusting the center height of the rest blade to the preferred center height. Finally, the assembled rest blade holder is bolted to the main frame 2 by socket head cap screws 40 that pass through the base clamp 38. The base clamp is stepped to permit a very strong union between the rest blade holder and the main frame.

The preferred center height of the rest blade is such that the ferrules are worked by the grinding means at a position about 0.025 to about 0.045 inches above the center of the ferrules. Prior to the present invention, ceramic ferrule grinding machines were used with the ferrules positioned such that they were worked below their center by the grinding means. Grinding below center frequently caused finished ferrules to have a slightly elliptical shape. Thus, the finished ferrules often did not have the desired concentricity for use in carrying fiber optic cable. In the present invention, grinding the ferrules at about 0.025 to about 0.045 inches above center eliminates the problem of leaving finished ferrules with an elliptical shape. Therefore, the final concentricity of the ferrules produced by the present invention is more consistent.

Figure 9:
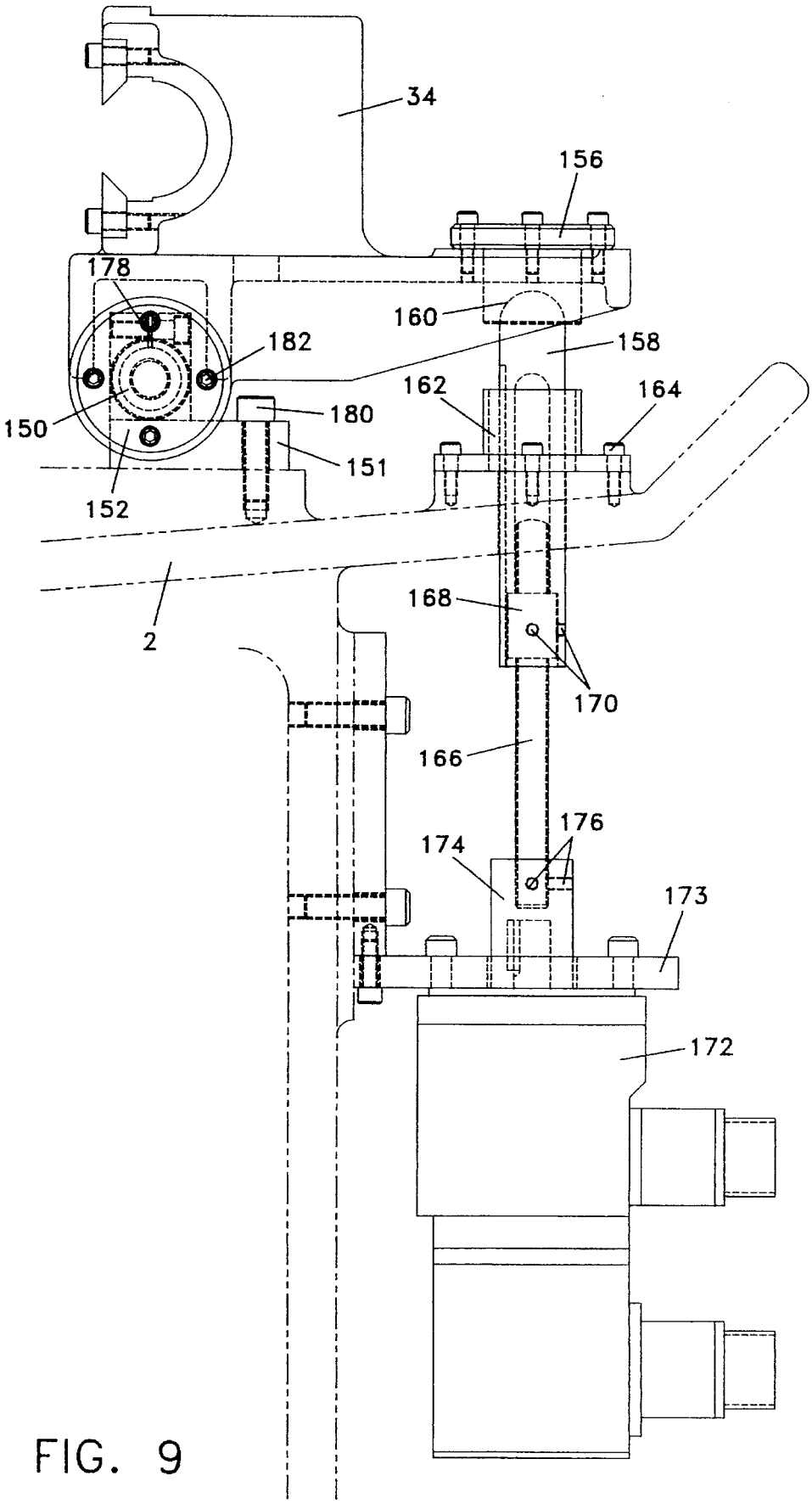
FIG. 9 is a left side view of the regulating wheel infeed assembly with a step motor.
Figure 10:
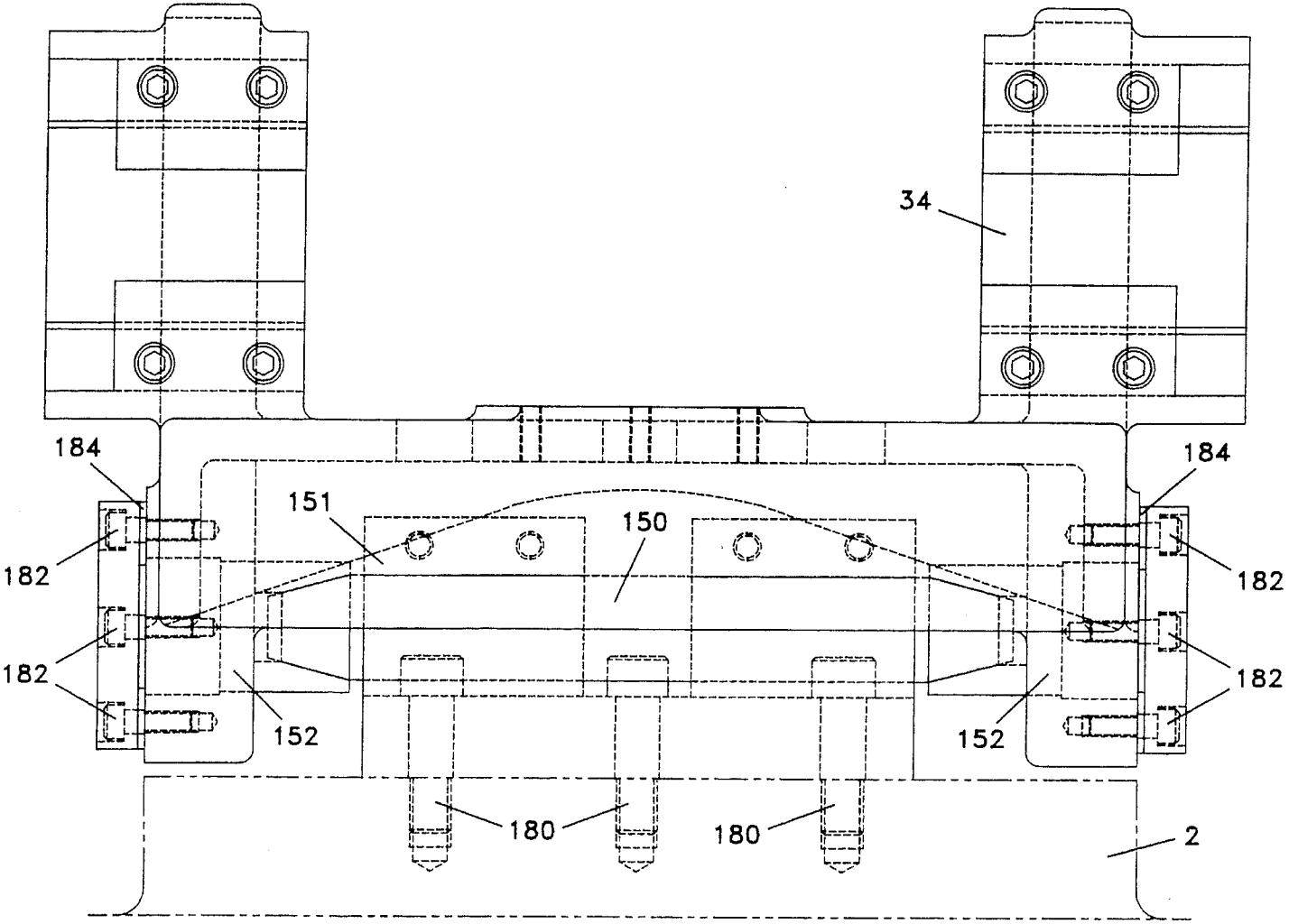
FIG. 10 is a front view of the pivot base portion of the regulating wheel infeed assembly.

FIG. 9 shows the regulating wheel infeed assembly 14 in more detail. A regulating wheel casting 34 pivots about a pivot shaft 150 and a pivot base 151. The pivot shaft is held in place by a pivot cap 152 with tapers ground into it that the shaft fits snugly into. FIG. 10 discussed below shows the pivot base assembly 18 in more detail, which is a part of the regulating wheel infeed assembly.

FIG. 9 further shows a preferred means for moving the regulating wheel casting about the pivot base assembly 18. A portion of the regulating wheel casting 34 protrudes out. This portion includes a hub 156 with a rounded recess that a shaft 158 having a spherical end 160 fits into. Together the rounded recess of the hub and the spherical end of the shaft permit the shaft to move within the hub as a ball and socket means.

The shaft 158 moves up and down to move the regulating wheel 52 in and out from the grinding wheel 42 causing the ferrules to be worked different amounts. The shaft passes through a part of the main frame 2 and a flange 162 appended to the main frame by screws 164. The majority of the shaft is hollow. A threaded lead screw 166 fits into the lower end of the shaft and into a lead screw nut 168 that is integrated into the lower end of the shaft. The lead screw turns within the stationary lead screw nut to move the shaft up and down. Set screws 170 are used to keep the lead screw nut from turning within the shaft. An infeed drive stepper motor 172 is mounted on the main frame via an infeed drive bracket 173 and is coupled to the lead screw. A standard coupling 174 is affixed to the shaft of the stepper motor and the lead screw couples to the coupling with set screws 176 used to secure the coupling and keep the lead screw turning with the stepper motor. The preferred stepper motor is a high precision motor that can move the ferrules in increments as small as 0.5 millions of an inch used in combination with the threaded lead screw and compound angles of movement of the regulating wheel infeed assembly. With a computer controlled variable stepper motor, the increments of infeed can vary according to the number of passes wanted in working the ferrule, thus varying the speed and precision of the work.

As mentioned, FIG. 10 shows the preferred pivot base assembly in detail. The pivot shaft 150 has male oriented tapered ends that fit into equivalently tapered female oriented receptacles of the pivot cap 152 with negligible or zero clearance. The pivot shaft passes through the hollow pivot base 151. The pivot base has a small split 178 along its top its entire length. Several screws pass through the top of the pivot base and are tightened to snugly hold the pivot shaft. The pivot base is held in place on the main frame 2 by screws 180. The pivot cap 152 is held within the regulating wheel casting 34 and screwed into place by screws 182. A spacer or shim 184 resides between the regulating wheel casting and the pivot cap to provide a strong connection. By this configuration, the regulating wheel infeed assembly operates very precisely. As a result, the regulating wheel can be fed accurately inward toward the grinding wheel to drive the ferrules and give them the exact concentricity and finish desired.

While a preferred form of the present centerless ceramic ferrule grinder invention has been shown in the drawings and described, variations in the invention's embodiment and practice will be readily apparent to those persons skilled in the art. Therefore, the invention should not be construed as limited to the specific form shown and described, but instead is as set forth in the following claims.

We claim:

1. A centerless grinder for shaping and finishing ceramic ferrules comprising:

A work traverse;

A means for oscillating the work traverse horizontally;

A wire support assembly for carrying about 30 ferrules appended to the work traverse that has at least one arm extending from each end thereof;

A wire for carrying the ferrules that is secured to each arm of the wire support assembly and held in tension;

At least one wire guide means associated with the wire support assembly to hold the wire straight along a predetermined path;

A grinding wheel means for removing material from the ferrules as the wire carries the ferrules across the grinding wheel means;

A regulating wheel means spaced apart from the grinding wheel means for spinning the ferrules and controlling the amount of material removed from the ferrules by the grinding wheel means;

An infeed means for moving the regulating wheel means in increments with relation to the grinding wheel means to assist in controlling the amount of material removed from the ferrules; and A rest blade assembly wherein the ferrules are supported on an upper edge of a rest blade between the regulating wheel means and the grinding wheel means and the rest blade is positioned such that the ferrules are worked above their center by the grinding wheel means.

2. A centerless grinder as set forth in claim 1, wherein at least one of said arms of said wire support assembly is mobile and provides tension to said wire.

3. A centerless grinder as set forth in claim 1, wherein said wire support assembly includes a first arm on one end thereof that is mobile and a second arm on the other end thereof that is stationary.

4. A centerless grinder as set forth in claim 2, wherein said wire support assembly includes a tension link having an eccentric release knob and a spring thereon with the tension link affixed to said mobile arm whereby the eccentric release knob is rotated to move the tension link and assist said mobile arm to apply tension to said wire.

5. A centerless grinder as set forth in claim 1, wherein said wire support assembly is detachable such that multiple wire support assemblies may be prepared with ferrules to be worked.

6. A centerless grinder as set forth in claim 5, wherein said detachable wire support assembly includes a means for securing by hand said wire support assembly to said work traverse, and a diamond dial pin in combination with a round dial pin for holding said wire support assembly parallel on said work traverse.

7. A centerless grinder according to claim 1 in which said rest blade is positioned such that said ferrules are worked between about 0.025 inches and about 0.045 inches above their center as said grinding wheel means removes material from said ferrules.

8. A centerless grinder as set forth in claim 1, wherein the upper edge of said rest blade is coated by diamond.

9. A centerless grinder as set forth in claim 1, wherein said grinding wheel means for removing material from said ferrules includes a grinding wheel and a variable speed motor for driving the grinding wheel at changeable speeds.

10. A centerless grinder as set forth in claim 1, wherein said grinding wheel means for removing material from said ferrules includes a grinding wheel having a surface grit of between 800 to 1200 U.S. standard mesh size.

11. A centerless grinder as set forth in claim 1, wherein said grinding wheel means for removing material from said ferrules includes a grinding wheel having a surface grit formed of diamond that is bonded within a resin medium.

12. A centerless grinder as set forth in claim 1, wherein said regulating wheel means for spinning said ferrules and controlling the amount of material removed from said ferrules includes a regulating wheel and a variable speed motor for driving the regulating wheel at changeable speeds.

13. A centerless grinder as set forth in claim 12, wherein said regulating wheel has an abrasive surface with a grit of about 400 U.S. standard mesh size mixed within a polyurethane resin.

14. A centerless grinder as set forth in claim 12, wherein said regulating wheel has a hardness of about 65 durameter on a D scale.

15. A centerless grinder as set forth in claim 1, wherein said infeed means for moving said regulating wheel means in increments includes an infeed drive stepper motor.

16. A centerless grinder as set forth in claim 1, wherein said infeed means includes a pivot base assembly having a shaft with male oriented tapered ends received within female oriented tapered receptacles of a pivot cap with negligible clearance, whereby said infeed means moves said regulating wheels means a precisely determined amount about the pivot base assembly.

17. A centerless grinder for shaping and finishing ceramic ferrules comprising:

A work traverse;

A means for oscillating the work traverse horizontally that is driven by a motor having variable speed and further includes a means for controlling the speed of the motor;

A wire support assembly for carrying about 30 ferrules appended to the work traverse that has at least one arm extending from each end thereof;

A wire for carrying the ferrules that is secured to each arm of the wire support assembly and held in tension;

At least one wire guide means associated with the wire support assembly to hold the wire straight along a predetermined path;

A grinding wheel means for removing material from the ferrules as the wire carries the ferrules across the grinding wheel means;

A regulating wheel means spaced apart from the grinding wheel means for spinning the ferrules and controlling the amount of material removed from the ferrules by the grinding wheel means;

An infeed means for moving the regulating wheel means in increments with relation to the grinding wheel means to assist in controlling the amount of material removed from the ferrules; and A rest blade assembly wherein the ferrules are supported on an upper edge of a rest blade between the regulating wheel means and the grinding wheel means while the ferrules are worked by the grinding wheel means.

18. A method of shaping and finishing ceramic ferrules comprising the steps of:

threading about 30 ferrules on a wire;

holding the wire in tension with the ferrules thereon;

supporting the wire with at least one wire guide;

positioning the wire such that the ferrules are held between a regulating wheel and a grinding wheel and supported by a rest blade such that the ferrules are worked above their center;

traversing the wire horizontally; and feeding the regulating wheel incrementally toward the grinding wheel to control the amount of material removed as the ferrules are worked;

whereby, the ceramic ferrules are shaped concentrically and provided a very fine surface finish.

19. A method of shaping and finishing ceramic ferrules as set forth in claim 18, wherein the ferrules are supported by said rest blade such that said ferrules are worked between about 0.025 inches and about 0.045 inches above their center.

* * * * *